US005842287A

United States Patent [19]

Murphy

[11] Patent Number: 5,842,287

[45] Date of Patent: Dec. 1, 1998

[54] TOWEL WARMER

[76] Inventor: Willard J. Murphy, 611 S. 22nd St., Monticello, Minn. 65301

[21] Appl. No.: 838,360

[22] Filed: Apr. 8, 1997

[51] Int. Cl.[6] ..... F26B 19/00

[52] U.S. Cl. ..... 34/202; 34/215; 34/225; 34/233; 219/400; 219/521

[58] Field of Search ..... 34/202, 215, 225, 34/233, 91, 621; 219/400, 386, 521

[56] References Cited

U.S. PATENT DOCUMENTS

| | | | |
|---|---|---|---|
| Re. 32,616 | 3/1988 | Graham . | |
| 2,668,368 | 2/1954 | Jacobs . | |
| 2,835,049 | 5/1958 | Jacobs . | |
| 3,299,529 | 1/1967 | Roberts et al. . | |
| 3,518,776 | 7/1970 | Wolff et al. . | |
| 3,563,460 | 2/1971 | Nine . | |
| 3,849,629 | 11/1974 | Graham, Jr. . | |
| 4,094,076 | 6/1978 | Baslow . | |
| 4,108,242 | 8/1978 | Searight et al. . | |
| 4,117,309 | 9/1978 | Cayley . | |
| 4,199,873 | 4/1980 | Hansen et al. . | |
| 4,205,460 | 6/1980 | Taylor . | |
| 4,412,392 | 11/1983 | Keller . | |
| 4,559,903 | 12/1985 | Bloom et al. | 119/19 |
| 4,625,432 | 12/1986 | Baltes . | |
| 4,694,146 | 9/1987 | DeMars . | |
| 4,737,616 | 4/1988 | Wen-Ying . | |
| 4,918,290 | 4/1990 | DeMars | 219/400 |
| 5,003,707 | 4/1991 | Chu . | |
| 5,014,446 | 5/1991 | Reesman . | |
| 5,379,525 | 1/1995 | Raynor . | |
| 5,443,538 | 8/1995 | Little . | |
| 5,548,100 | 8/1996 | Miller | 219/521 |
| 5,606,640 | 2/1997 | Murphy . | |

FOREIGN PATENT DOCUMENTS

| | | |
|---|---|---|
| 48835 | 5/1974 | Australia . |
| 54-108964 | 8/1979 | Japan . |
| 1428107 | 3/1976 | United Kingdom . |

*Primary Examiner*—Henry A. Bennett
*Assistant Examiner*—Pamela A. Wilson
*Attorney, Agent, or Firm*—Andrus, Sceales, Starke & Sawall

[57] ABSTRACT

An apparatus for warming towels, or other articles. The apparatus includes a cabinet having an internal vertical wall that divides the cabinet into a warming chamber and a second chamber. A tubular rack extends generally horizontally across the warming chamber and is adapted to support a towel, or other article to be warmed. An open inlet end of the rack extends through the interior wall. An integral air supply unit is located within the second chamber and includes a motor driven fan or blower and a pair of discharge channels are connected to the discharge side of the fan. The upper end of one channel registers with the inlet of the rack, while the open upper end of the other channel communicates with the upper end of the warming chamber. The air discharge unit is removably connected within the second chamber in a manner to cause registry of the upper end of the first channel with the inlet of the rack.

12 Claims, 2 Drawing Sheets

TOWEL WARMER

BACKGROUND OF THE INVENTION

Hotels, motels and bed-and-breakfasts are constantly seeking a product to meet the commercial market needs and provide a competitive edge. One product for creating a competitive edge is a towel warmer that is used to warm a towel in a relatively short period of time. Various types of towel warmers have been proposed in the past. For example, U.S. Pat. No. 3,849,629 described a towel warmer which is adapted to be suspended from a towel bar or other support and includes an electrical heating element which is mounted on the inner surface of a removable door in the bottom of the cabinet.

U.S. Pat. No. 4,177,309 discloses an electric towel warmer including an inverted, U-shaped rack which extends upwardly from the bottom of the cabinet or housing and is adapted to support a towel to be warmed. An electric heating element having a sinuous configuration is mounted within the perforated rack. U.S. Pat. No. 4,694,146 describes a towel warmer having a cabinet formed of a pair of hinged sections. An electric heating element is located between the two sections of the cabinet and is covered by a fiber glass screen which acts to protect the towel support and the heating elements.

U.S. Pat. No. 4,849,610 shows a towel rack including a plurality of spaced parallel racks for supporting towels and heating elements located on either side of the heating chamber.

U.S. Pat. No. 5,014,446 shows a towel warmer which incorporates a standard hair dryer. The outlet of the hair dryer is received within an opening in the lower end of the cabinet, and the heated air passes upwardly through a towel supported on a perforated divider shelf, with the air being vented through openings in the lid of the cabinet.

United States patent application Ser. No. 08/561,408, filed Nov. 21, 1995, describes a towel warmer in which a hollow rack is mounted within the upper portion of the cabinet and the towel is draped over the rack. Heated air is supplied to the interior of the rack through a standard portable electric hair dryer, and a baffle is incorporated in the inlet of the rack and serves to direct a portion of the heated air upwardly and over the outer surface of the towel, while the remaining portion of the heated air is directed into the rack and is discharged through suitable outlet ports in the rack into contact with the inner surface of the towel.

SUMMARY OF THE INVENTION

The invention is directed to an improved apparatus for warming towels or other articles and has particular application for use in a hotel, motel, or bed and breakfast.

In accordance with the invention, the towel warmer includes a cabinet having an open top enclosed by a hinged lid. A vertical interior wall divides the cabinet into a warming chamber and a second chamber, and a hollow rack is mounted within the upper portion of the warming chamber in position to receive a towel that is draped over the rack. An integral air supply unit is removably mounted in the second chamber and includes a source of heated air, which preferably can take the form of a motor driven fan and an electrical heating element to heat the air discharged by the fan. A pair of discharge channels or chutes are connected to the discharge side of the fan. The open upper end of one channel communicates with an inlet to the rack, so that heated air is supplied to the interior of the rack, while the open upper end of the second channel communicates with the upper portion of the warming chamber above the rack, so that heated air will be discharged to the upper end of the warming chamber and will then flow downwardly along the outer surface of the towel.

As a feature of the invention, a mechanism is included to removably mount the air supply unit within the second chamber. In the preferred form of the invention, guideways are provided on the interior wall and guides on the channels engage the guideways to position the air supply unit within the second chamber and cause registry of the upper end of the first channel with the inlet of the rack. With this construction, the air supply unit can be readily removed as an integral unit from the second chamber for replacement.

As a further feature of the invention, a timer switch is mounted on the cabinet and is connected in an electrical circuit with the fan motor and with heating elements in the air channels. In addition, a thermostatic control is mounted in the warming chamber and is connected in the electrical circuit and acts to open the circuit to the power supply if the temperature in the cabinet rises above a pre-selected value, thus preventing overheating and possible damage to the cabinet or other components of the towel warmer.

Other objects and advantages will appear in the course of the following description.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
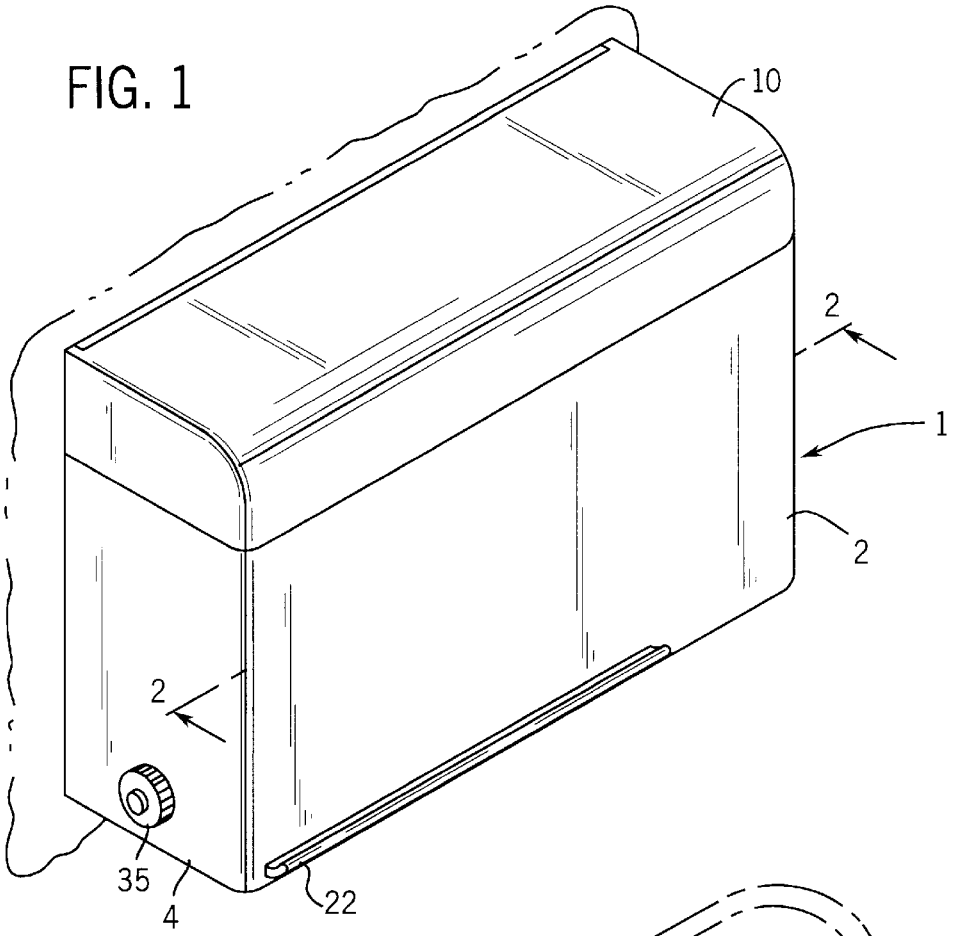
FIG. 1 is a perspective view of the towel warmer of the invention.

FIG. 1 illustrates the towel warmer of the invention including an open top cabinet or housing 1 that is composed of a front wall 2, a rear wall 3 a pair of end walls 4 and 5, and a bottom wall 6. As shown in the drawings, the cabinet is preferably wall mounted, although it is contemplated that in certain circumstances the cabinet can be free standing, in which case the cabinet can be provided with supporting legs.

Located within cabinet 1 is a vertical interior wall 7 which divides the cabinet into a warming chamber 8 and an auxiliary chamber 9. A cover 10 is hinged to the upper edge of rear wall 3 and is movable between a closed and an open position. The hinge is constructed in a manner such that the cover can be moved to a full-open vertical position when the cabinet is wall mounted.

Figure 4:
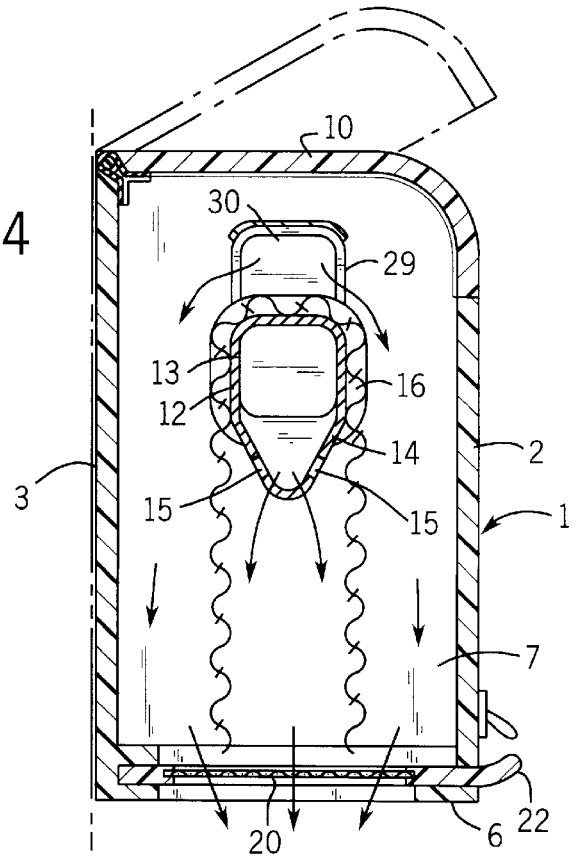
FIG. 4 is a section taken along line 4—4 of FIG. 2.
Figure 2:
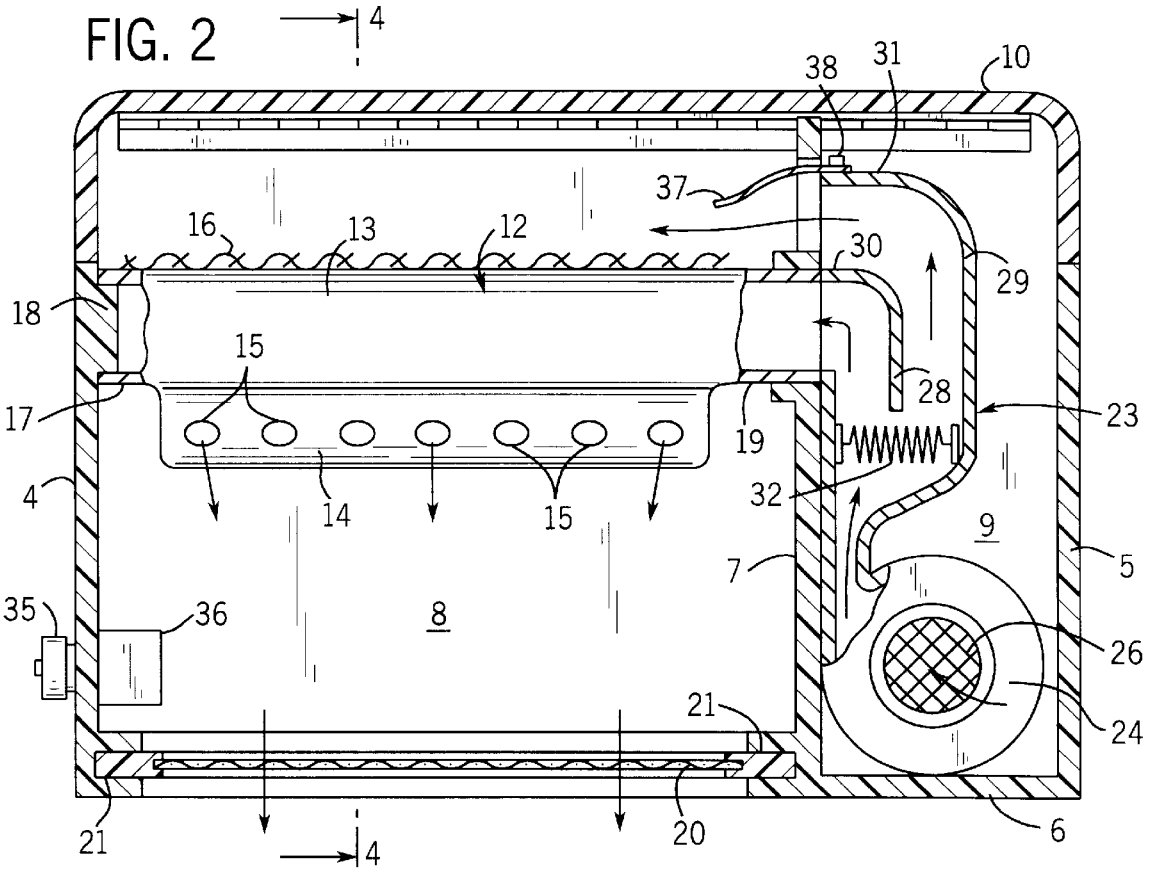
FIG. 2 is a vertical section of the towel warmer.

Mounted horizontally within warming chamber 8 is a tubular rack 12 having an upper section 13 that is generally rectangular in cross-section and a lower section 14 which has a reduced width. A plurality of outlet openings 15 are formed in lower section 14 and serve to discharge heated air against the inner surface of a towel 16 that is draped over the rack 12, as shown in FIG. 4.

To connect end 17 of rack 12 to end wall 4, a generally rectangular boss 18 projects inwardly from the end wall and is received within the open end 17 of rack 12.

The opposite open end 19 of tubular rack 12 is mounted within an opening in wall 7, and heated air is supplied to the interior of the rack through opening 19, as will be hereinafter described.

To filter out lint and other particulate material from the air being discharged from cabinet 1, a filter screen 20 is slidably mounted within guideways 21 formed in bottom wall 6 of the cabinet. A lip 22 is formed on the forward edge of filter screen 20, and projects outwardly of the front wall 2 of the cabinet in a location where it can be readily grasped. This enables the filter screen 20 to be readily removed for cleaning.

As a feature of the invention, an integral air supply unit 23 is removably mounted in the auxiliary chamber 9. Air supply unit 23 includes a conventional fan or blower 24 which is driven by a motor 25. The suction side of fan 24 is provided with an inlet opening 26 which communicates with a screened opening 27 in end wall 5, so that air from the atmosphere will be drawn into the fan.

The discharge of fan 24 is connected to a pair of air channels or chutes 28 and 29, both of which, as shown in the drawings, have a generally rectangular cross-section. The open upper end 30 of channel 28 is aligned with and communicates with the open end 19 of rack 12, while the open upper end 31 of channel 29 is located above end 30 and serves to discharge air into warming chamber 8 above the level of the rack. Suitable electrical heating elements 32 are mounted in channels 28 and 29 to heat the air flowing therethrough.

With this construction, the air passing through channels 28 and 29 is heated and the heated air is discharged from end 30 of channel 28 into the interior of rack 12. The air then passes through outlet openings 15 into engagement with the inner surface of the towel 16. The heated air being discharged from the upper end 31 of channel 29 flows into the upper end of the cabinet and then passes downwardly along the outer surface of the towel 16, so that both the inner and outer surfaces of the towel will be heated or warmed.

Figure 3:
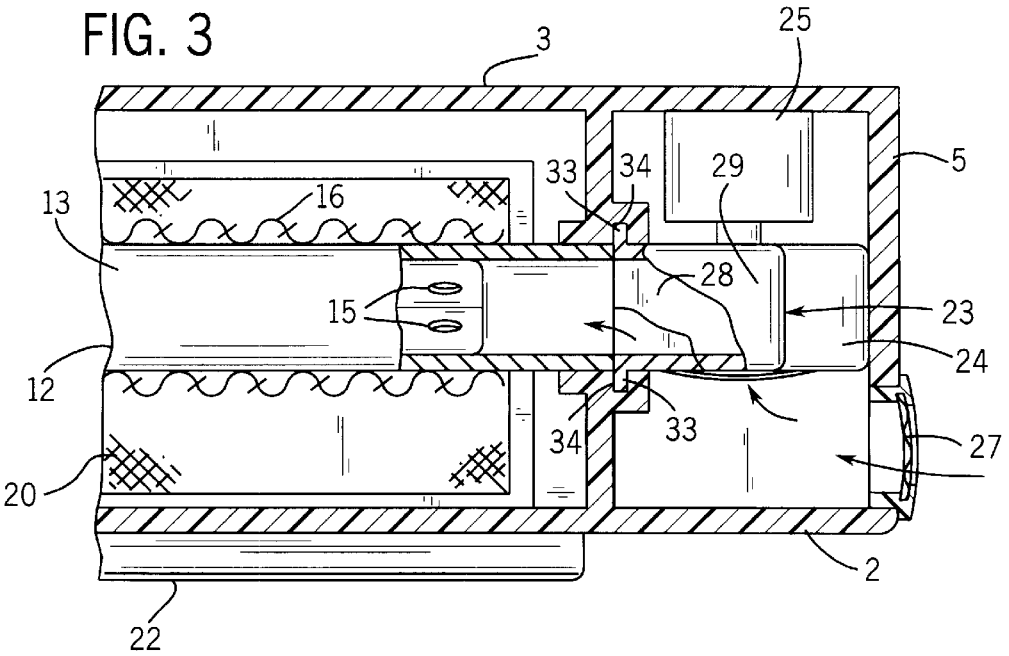
FIG. 3 is a horizontal section of the towel warmer with parts broken away.

The air supply unit 23 is removably mounted in chamber 9, so that it can be readily removed for replacement, if necessary. This is an important feature when the unit is used in an environment, such as a hotel or motel, where the towel warmer would see considerable daily use. To mount air supply unit within chamber 9, channel 28 is provided with a pair of side flanges 33 which are received within vertical guideways 34 on interior wall 7, as best seen in FIG. 3. By sliding the unit 23 downwardly with the flanges 33 registering with guideways 34 until fan 24 bottoms out on wall 6, the upper end 30 of channel 28 will be brought into proper registry with the inlet opening 19 of the rack. It is not necessary to provide a tight seal between end 30 of channel 28 and the inlet end 19 of the rack, because any heated air escaping through the joint will merely be discharged into the cabinet.

As a feature of the invention, electrical power to motor 25 and to the heating elements 32 is controlled by a timer switch 35 that is mounted on the lower portion of end wall 4. Timer switch 35 is connected in an electrical circuit with a conventional thermostatic control 36, which is located on the inside of end wall 4. Actuating the timer 35 will energize the motor 25 and heating elements 32 to thereby warm the towel or other article suspended on rack 12. As a secondary benefit, the heated air being discharged from the cabinet through screen 20 will warm the bathroom. The thermostatic control 36 is a standard type, being responsive to a preselected elevated temperature in cabinet 1. If the temperature exceeds the preselected value, the thermostatic control will operate to open the circuit between the power source and the heating elements 32, thus preventing overheating and possible damage to components of the towel warmer, particularly if such components are made of plastic material.

As a further feature of the invention, a strip 37 of fabric impregnated with a fabric softener can be attached to the upper or outlet end 31 of channel 29. The strip 37 can be attached to the channel by engagement of an annular grommet on the end of the strip with an upstanding peg 38 on the channel 29. When the fan or blower 24 is operated, the heated air being discharged from the upper end 31 of channel 29 will blow the strip outwardly and the fabric softening material will be entrained in the air stream to thereby aid in softening the towel, or other article that is draped over the rack 12.

While the drawings show the air being heated by an electrical heating element 32, it is contemplated that other heat source, such as for example, a microwave heating unit, can be utilized.

I claim:

1. An apparatus for warming articles, comprising an outer cabinet including a pair of generally parallel side walls and a pair of end walls connecting said side walls together, an interior wall disposed generally parallel to said end walls and dividing said cabinet into a first chamber and a second chamber, a tubular rack disposed in said first chamber and extending generally horizontally between one of said end walls and said interior wall, said rack having an inlet extending through said interior wall, an integral air supply unit removably mounted in said second chamber and including a blower, drive means to drive the blower and a pair of air channels connected to the discharge side of said blower, heating means for heating air flowing through said channels, a first of said channels having an open upper end communicating with the inlet of said rack whereby heated air is delivered to the interior of said rack, outlet means in the rack for discharging heated air from the rack into contact with an article draped over the rack, the second of said channels having an open upper end communicating with the upper portion of said first chamber at a level above said rack, and means for removably connecting said unit in said second chamber to thereby cause registry of the open upper end of said first channel with said inlet.

2. The apparatus of claim 1, wherein said first and second air channels are in side-by-side relation.

3. The apparatus of claim 2, wherein said air channels are generally rectangular in cross-section.

4. The apparatus of claim 3, wherein said rack includes an upper section having a generally rectangular cross section and a lower section having a lesser width than said upper section, said outlet means comprising a plurality of discharge outlets located in said lower section.

5. The apparatus of claim 1, wherein said connecting means comprises first guide means on said cabinet and second guide means on said unit, said second guide means being slidable relative to said first guide means to position said unit in said second chamber.

6. The apparatus of claim 5, wherein said first guide means comprises a pair of spaced vertical guideways on said cabinet and said second guide means comprises a pair of guide members slidable in said guideways.

7. The apparatus of claim 6, wherein said guideways are on said interior wall and said guide members are on said first channel.

8. The apparatus of claim 1, and including an on-off switch connected in an electrical circuit with said heating means and with said blower, and a thermostatic control connected in said electrical circuit, said thermostatic control acting to open said electrical circuit when the temperature in the cabinet reaches a preselected elevated value.

9. The apparatus of claim 1, and including a flexible strip impregnated with a fabric softener and mounted in the cabinet in a location to be engaged by air flowing through one of said channels.

10. The apparatus of claim 9, wherein the strip is mounted at the open upper end of said second channel.

11. An apparatus for warming articles comprising an outer cabinet including a pair of generally parallel side walls and a pair of end walls connecting said side walls together, an interior wall disposed in spaced parallel relation to said end walls and dividing said cabinet into a warming chamber and a second chamber, a tubular rack disposed in said warming chamber and extending generally horizontally between one of said end walls and said interior wall, said rack having an inlet extending through said interior wall and communicating with said second chamber, said rack also having a plurality of discharge openings, an integral air supply unit disposed in said second chamber and including blower means and a pair of air channels connected to the discharge side of said blower means, a first of said channels having an open upper end communicating with the inlet of said rack and the second of said channels having an open upper end communicating with the upper portion of said first chamber above the level of said rack, electrical heating means for heating the air flowing within said channels, whereby heated air is discharged through said first channel into the interior of the rack and is then discharged through said outlet openings into contact with the inner surface of an article draped on the rack and heated air is discharged from the open upper end of said second channel and flows downwardly along the outer surface of said article, and connecting means for removably connecting said unit in said second chamber to thereby cause registry of the upper end of said first channel with the inlet of said rack, said connecting means comprising first guide means on said interior wall and second guide means on said unit and engageable with said first guide means.

12. The apparatus of claim 11, wherein said first guide means comprises a pair of spaced guideways on said interior wall and said second guide means comprises a pair of flanges on said first channel, each of said flanges being slidably engaged with one of said guideways.

* * * * *